US008082869B2

(12) United States Patent
Beaty

(10) Patent No.: US 8,082,869 B2
(45) **Date of Patent: *Dec. 27, 2011**

(54) ANCHOR SYSTEM FOR A KAYAK

(76) Inventor: Benny R. Beaty, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/952,119

(22) Filed: Nov. 22, 2010

(65) Prior Publication Data

US 2011/0061580 A1 Mar. 17, 2011

Related U.S. Application Data

(63) Continuation of application No. 12/185,113, filed on Aug. 3, 2008, now Pat. No. 7,861,661.

(51) Int. Cl.
*B63B 21/00* (2006.01)

(52) U.S. Cl. ..... 114/230.1; 114/294; 114/347

(58) Field of Classification Search ..... 114/230.1, 114/294, 347

See application file for complete search history.

(56) References Cited

U.S. PATENT DOCUMENTS

| | | | |
|---|---|---|---|
| 415,501 | A | 11/1889 | Cole |
| 2,009,356 | A | 7/1935 | De Seversky |
| 2,092,011 | A | 9/1937 | Musham |
| 2,526,953 | A | 10/1950 | Kruse |
| 2,881,591 | A | 4/1959 | Rimsey |
| 2,991,750 | A | 7/1961 | Letourneau |
| 3,238,912 | A | 3/1966 | Perlick |
| 5,025,746 | A | 6/1991 | Boulter |
| 5,062,376 | A | 11/1991 | Tremblay |
| 6,041,730 | A | 3/2000 | Oliverio |
| 6,220,197 | B1 | 4/2001 | Pohlman |
| 6,273,016 | B1 | 8/2001 | Gibbs |
| 2002/0108544 | A1 | 8/2002 | Hsu |
| 2006/0207489 | A1 | 9/2006 | Waldrop |
| 2007/0181051 | A1 | 8/2007 | Waldrop |

*Primary Examiner* — Stephen Avila
(74) *Attorney, Agent, or Firm* — Gordon G. Waggett, P.C.

(57) ABSTRACT

Apparatus and system are disclosed for anchoring a kayak to the bottom of a body of shallow water. In one embodiment, the apparatus includes a tube for attachment to the kayak proximate the upper portion of the kayak between the bow and the stern of the kayak, and a shaft which is disposed in the tube. A gear box is provided proximate the seat which comprises a gearing mechanism for operative engagement with the shaft, and a rotatable handle which is external to the gear box for operative connection to the gearing mechanism. The rotatable handle, when rotated in a first direction, deploys the shaft from a position inside the tube to a position outside the tube and into engagement with the bottom of the body of water. An anchoring system according to this embodiment permits the operator of the kayak to anchor the kayak at the bow or stern.

32 Claims, 9 Drawing Sheets

ANCHOR SYSTEM FOR A KAYAK

CROSS-REFERENCE TO THE RELATED APPLICATION

This application is a continuation of U.S. application Ser. No. 12/185,113, filed Aug. 3, 2008, now U.S. Pat. No. 7,861,661 issued Jan. 4, 2011.

BACKGROUND OF THE INVENTION

1. Field of the Invention

The present invention relates to a system for anchoring a kayak in shallow water.

2. Description of the Prior Art

Fishing is a popular sport, and this popularity has prompted the development of many fishing aids designed to assist the fisherman. Fishermen frequently need to maintain the position of their boats, and various techniques have been developed which purport to assist the fisherman in that regard. Such techniques are, for example, disclosed in U.S. Patent Application Publication 2006/0207489; U.S. Pat. No. 6,273,016; U.S. Pat. No. 3,238,912; and U.S. Pat. No. 5,062,376.

Kayaking and kayak fishing have grown in popularity in recent years, and since the kayak is a lightweight craft, winds and currents may often cause the kayak to drift away from a desired position. It is often essential, therefore, that the kayak operator (whether fisherman or photographer) be able to anchor his or her kayak at a particular location. Anchoring systems for kayaks have, however, been quite rustic and have consisted for the most part of a weight attached to a rope which the kayak operator drops into the water near the seat of the kayak to anchor the kayak. These weights tend to be noisy when deployed and such noise tends to scare away the fish or other wildlife in the vicinity of the kayak. Also, such weights tend to be bulky and cumbersome to use.

It is often advantageous to be able to anchor a boat both at the bow and the stern of the boat, and this would be especially true in the case of a lightweight kayak. Developing a suitable system for anchoring a kayak both at the bow and the stern is complicated by the fact that the operator of a kayak must remain seated or run the very substantial risk of capsizing the kayak, if the operator were to attempt a move from the seat of the kayak to another position on the kayak.

A system which allows a kayak operator to anchor the kayak either at the bow or the stern of the kayak or both and to do so from the seat of the kayak using only one hand would be desirable. This new and useful result has been achieved by the anchoring system of the present invention.

SUMMARY OF THE INVENTION

In accordance with the present invention, apparatus is provided for anchoring a kayak to the bottom of a body of water. The kayak comprises a hull having a bow and stern and upper and lower portions and a seat disposed in the hull between the bow and stern. In one embodiment, the anchoring apparatus comprises a tube which may be attached to the kayak proximate the upper portion of the kayak between the bow and stern of the kayak. A shaft is installed in the tube, and the shaft is preferably a rack and pinion gear driven shaft. In this embodiment, anchoring apparatus according to the present invention further comprises a gear box which may be attached to the kayak proximate the seat of the kayak, where the gear box comprises a gear for operative engagement with the shaft, and a rotatable handle external to the gear box for operative connection to the gear in the gear box. When the handle is rotated in a first direction, the shaft is deployed from a position inside the first tube to a position outside of the first tube and into engagement with the bottom of a body of water. The shaft may be returned to the tube by rotating the handle in the opposite direction from which it was rotated to deploy the shaft.

In one embodiment, the shaft is deployed from the tube at a location proximate the bow of the kayak, while in a second embodiment, the shaft is deployed from the tube at a location proximate the stern of the kayak.

In another embodiment, apparatus for anchoring a kayak to the bottom of a body of water is provided where the apparatus comprises first and second tubes which may be attached to the kayak proximate the upper portion of the kayak between the bow and stern of the kayak. First and second shafts are disposed in the first and second tubes, respectively, and these shafts may be deployed from the tubes and into engagement with the bottom of the body of water. Anchoring apparatus in this embodiment also comprises a gear box which may be attached to the kayak proximate the seat of the kayak which comprises a first gearing mechanism for operative engagement with the first shaft and a second gearing mechanism for operative engagement with the second shaft. A rotatable handle external to the gear box is provided for operative connection to the first and second gearing mechanisms in the gear box.

The gear box further comprises first and second actuation devices which are external to the gear box and which have first and second positions. When the first and second actuation devices are in their respective first positions, operative connection is enabled between the first and second gearing mechanisms and the handle, so that when the handle is rotated in a first direction, the first and second shafts are deployed out of the first and second tubes. The shafts, when deployed, engage the bottom of the body of water and anchor the kayak. When the first and second actuation devices are in their respective second positions, operative connection between the first and second gearing mechanisms and the handle is disabled.

In one embodiment of the present invention, the actuation devices comprise switches, while in another embodiment, the actuation devices comprise levers.

Anchoring apparatus according to the present invention further comprises rollers in the tubes on which the shafts move as they are deployed. The shafts may also comprise at least one connector bolt to permit rotation of the shaft as it is deployed.

Various accessories may be included in embodiments of the anchoring apparatus of the present invention. For example, such accessories may include foldable lights which are attached to the tubes to permit the kayak to be seen at times when lighting is dim. Additionally, such accessories may include depth indicators on the shafts. Such depth indicators may, for example, be implemented by forming a window in each tube and applying markings to the shafts to indicate the depth to which each shaft has been deployed. A further accessory may comprise a paddle holder.

DESCRIPTION OF THE SPECIFIC EMBODIMENTS

It will be appreciated that the present invention may take many forms and embodiments. In the following description, some embodiments of the invention are described and numerous details are set forth to provide an understanding of the present invention. Those skilled in the art will appreciate, however, that the present invention may be practiced without those details and that numerous variations and modifications from the described embodiments may be possible. The following description is thus intended to illustrate and not to limit the present invention.

Figure 1:
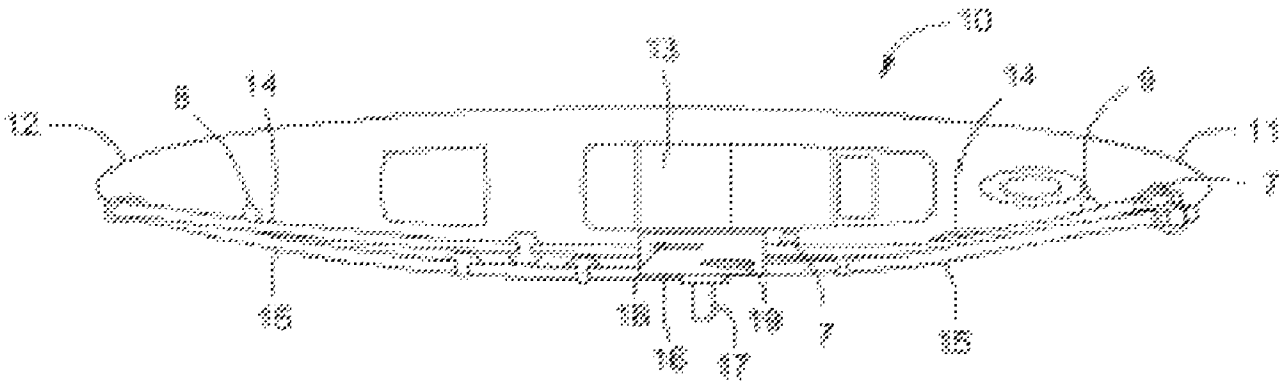
FIG. 1 is a top view of a kayak containing anchoring apparatus in accordance with the present invention.
Figure 2:
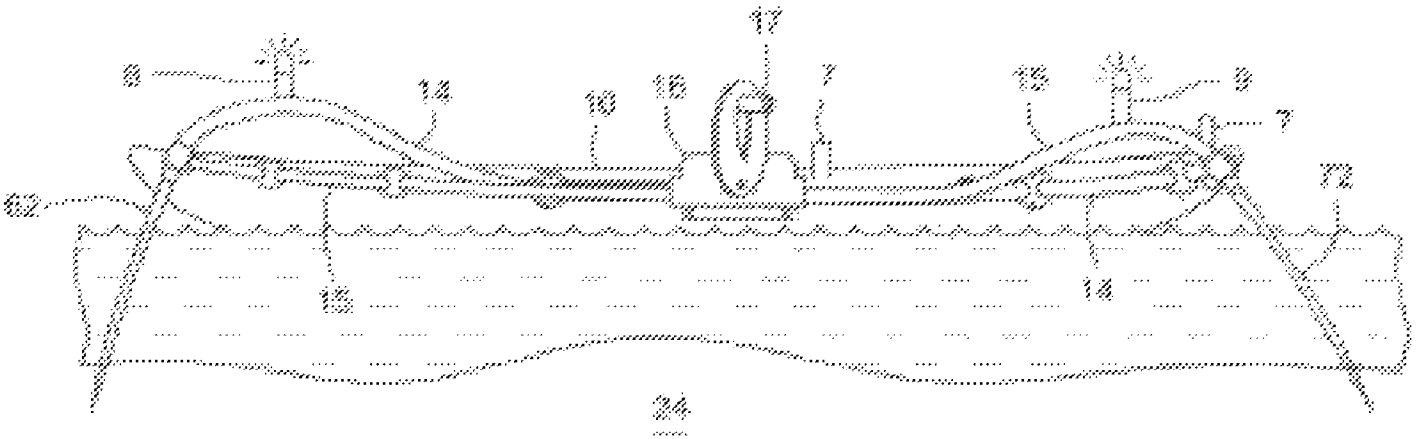
FIG. 2 is a side view of the kayak illustrated in FIG. 1.

With reference first to FIGS. 1 and 2, there is illustrated a kayak 10 having a bow 11 and a stern 12. Interposed between the bow 11 and the stern 12 is a seat 13 for the operator. One embodiment of an anchoring system in accordance with the present invention comprises tubes 14 and 15 which may be attached to one side of kayak 10 and have a length equal to approximately the length of the kayak 10. Interposed between the ends of tubes 14 and 15 is a gear box 16 which comprises a handle 17 and actuation devices (as discussed below) and which may be attached to the kayak proximate the operator's seat 13.

While the anchoring system in FIG. 1 is illustrated as being installed on the right-hand side of kayak 10, those skilled in the art who have the benefit of the present disclosure will appreciate that the anchoring system comprising tubes 14 and 15 and gear box 16 may instead be installed on the left-hand side of kayak 10.

Figure 3A:
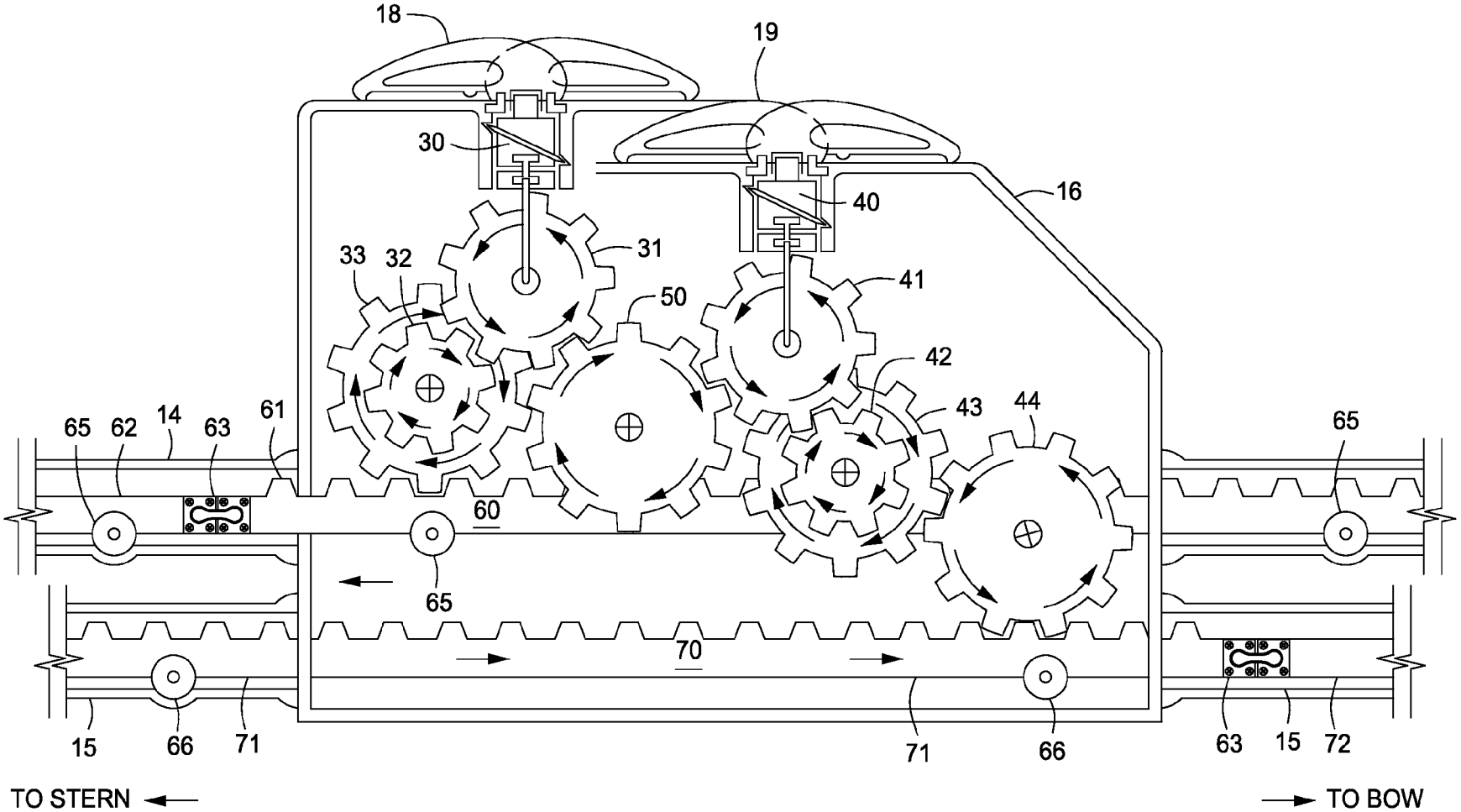
FIG. 3A is an elevation drawing in partial cross-section of a gear box that is used in one embodiment of the anchoring system of the present invention.
Figure 3B:
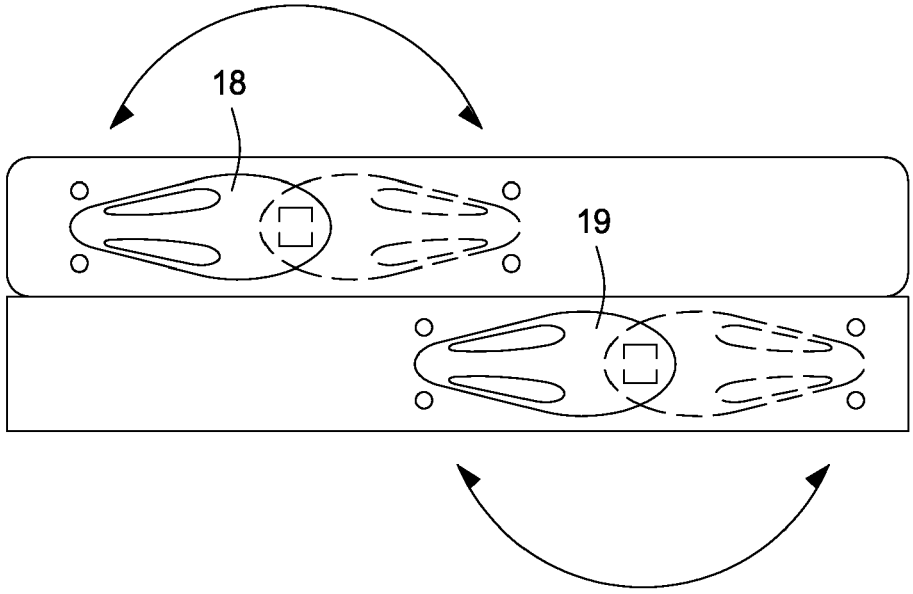
FIG. 3B is a top view of the gear box illustrated in FIG. 3A.

With reference now to FIGS. 3A and 3B, one embodiment of gear box 16 is illustrated. In this embodiment, the actuation devices comprise switches 18 and 19 which have two positions which are 180° apart and which are illustrated most clearly in FIG. 3B. Switch 18 is connected via swivel bolt 30 to gear wheel 31. Switch 19 is connected via swivel bolt 40 to gear wheel 41. Turning switch 18 between its two positions which are 180° apart raises and lowers gear wheel 31 into engagement or disengagement with gear wheel 50 and gear wheels 32 and 33. Similarly, turning switch 19 between its two positions which are 180° apart raises and lowers gear wheel 41 into engagement or disengagement with gear wheel 50 and the gear wheels 42, 43 and 44. The gear wheel 50 is connected to handle 17. Switch 18, when in a first position such that gear wheel 31 is lowered, functions to enable operative connection between the gear wheels 32 and 33 and the handle 17, and when switch 18 is in its second position such that gear wheel 31 is not lowered, operative connection between the gear wheels 32 and 33 and the handle 17 is disabled. Similarly, switch 19, when in a first position such that the gear wheel 41 is lowered, functions to enable operative connection between the gear wheels 42, 43 and 44 and the handle 17, and when switch 19 is in its second position such that gear wheel 41 is not lowered, operative connection between the gearwheels 42, 43 and 44 and the handle 17 is disabled.

Figure 6:
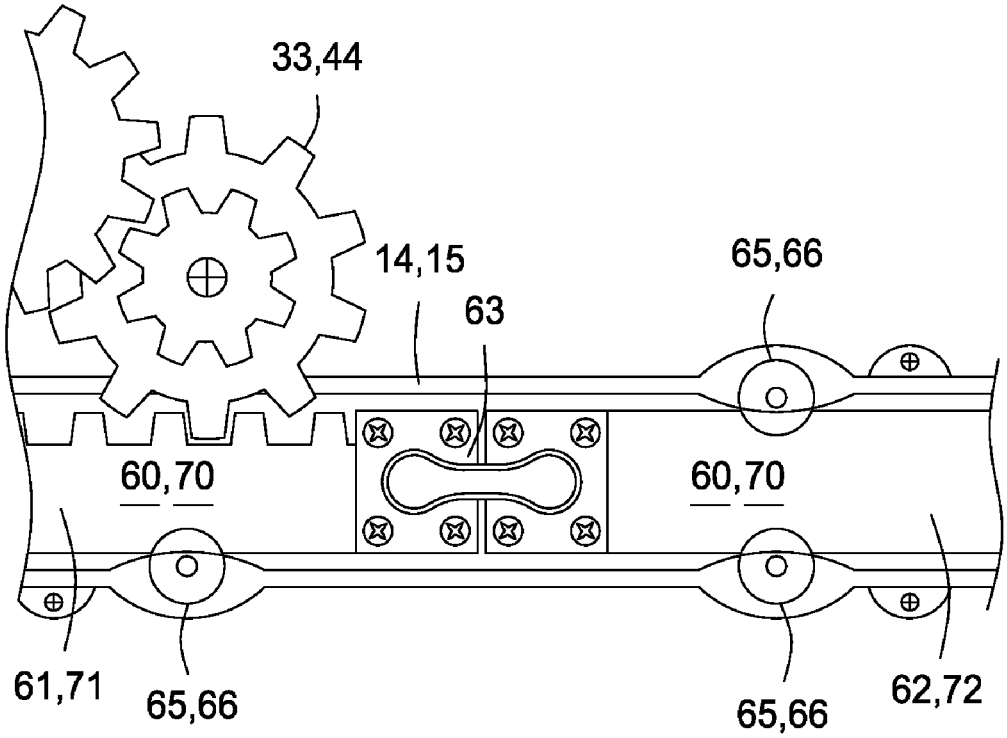
FIG. 6 is a cross-sectional view of one of the tubes illustrated in FIG. 1 taken along the longitudinal axis of the tube.

With reference now to FIGS. 2, 3A and 6, each tube 14, 15 contains a shaft 60,70 comprising a toothed portion 61, 71, respectively, and a probe portion 62, 72, respectively, where the probe portions 62, 72 have a smooth surface to facilitate penetration into the bottom 24 of a body of water. Toothed portions 61, 71 may be joined to probe portions 62, 72, respectively, by utilizing connector bolts 63 which permits the probe portions 62, 72 to rotate. Gear wheel 33 engages the toothed portion 61 of the shaft 60, and gear wheel 44 engages the toothed portion 71 of the shaft 70.

Figure 4A:
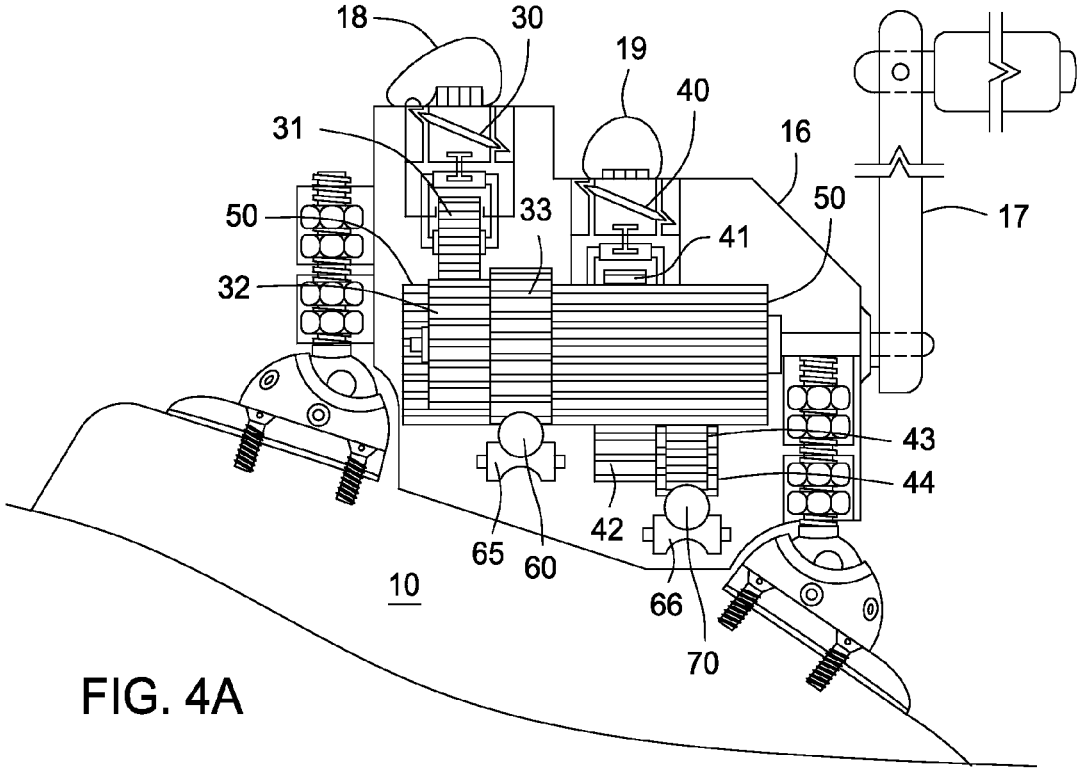
FIG. 4A is an elevation view in partial cross-section of the gear box illustrated in FIGS. 3A and 3B.

Referring now to FIG. 4A, the internal mechanisms of gear box 16 when viewed from the stern end of the gear box are illustrated. FIG. 4A illustrates the spatial relationship between switch 18, swivel bolt 30, and gear wheels 31, 32, 33 and 50. FIG. 4A also illustrates the spatial relationship between switch 19, swivel bolt 40, gear wheel 50 and gear wheels 41, 42, 43 and 44.

Figure 4B:
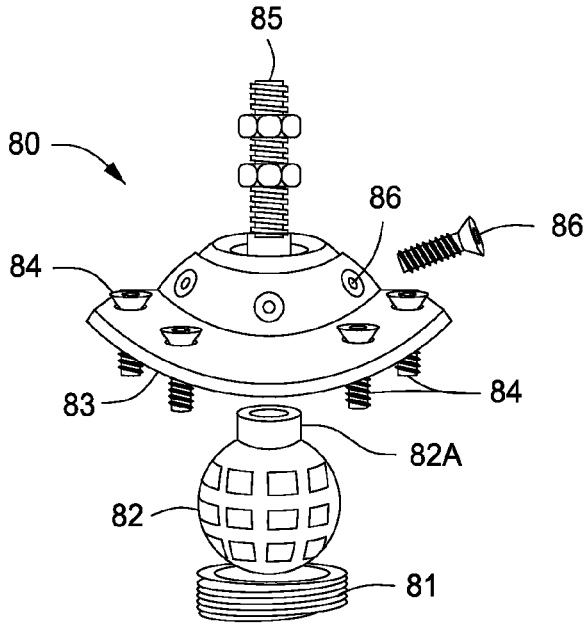
FIG. 4B is an exploded drawing of apparatus used to mount the gear box illustrated in FIG. 4A or in FIG. 5A to a kayak.

As illustrated in FIG. 4B, gear box 16 may advantageously be secured to kayak 10 by utilizing a plurality of mounting assemblies 80, and, in one embodiment, four such mounting assemblies are utilized. Mounting assembly 80 comprises base material 81 on which rotating ball 82 is disposed. A mounting base 83 fits over the cylindrical extension 82*a* of rotating ball 82 and is secured to the kayak 10 by utilizing a plurality of mounting screws 84. Adjusting bolt 85 may then engage the threaded portion of cylindrical extension 82*a*, and the orientation of adjusting bolts 85 may be determined by using a plurality of set screws 86.

In operation, the operator of the kayak 10 may elect to anchor the kayak at either the stern or at the bow or at both the stern and the bow simultaneously. In order to anchor the kayak both at the bow and the stern, switches 18 and 19 are each placed in the first position such that gear wheels 31 and 41, respectively, are lowered into operative engagement with gear wheels 32, 33, 50, 42, 43 and 44. The operator of the kayak then turns the handle 17 in a clockwise direction to lower the probe portions of shafts 60 and 70 into the bottom of the body of water in which the kayak is operating. As illustrated in FIGS. 3A and 6, a plurality of rollers 65, 66 may be included in each tube 14, 15, respectively, to facilitate movement of the shafts in the tubes by reducing friction. When the operator of the kayak is ready to weigh anchor, the probe portions of shafts 60 and 70 may be retracted from the anchoring position and into tubes 14 and 15 by turning the handle 17 in a counterclockwise direction.

If the operator desires only to anchor the kayak at the bow, the operator will only actuate the switch 19. Alternatively, if the operator desires to anchor only at the stern, the operator will only actuate the switch 18. If the kayak operator has elected to anchor only at the bow or stern, but later determines that anchoring at both locations is needed, the switch which was initially actuated is de-actuated, the switch which was initially de-actuated is actuated, and the handle 17 is rotated to deploy the other shaft into engagement with the bottom of the body of water.

Figure 5A:
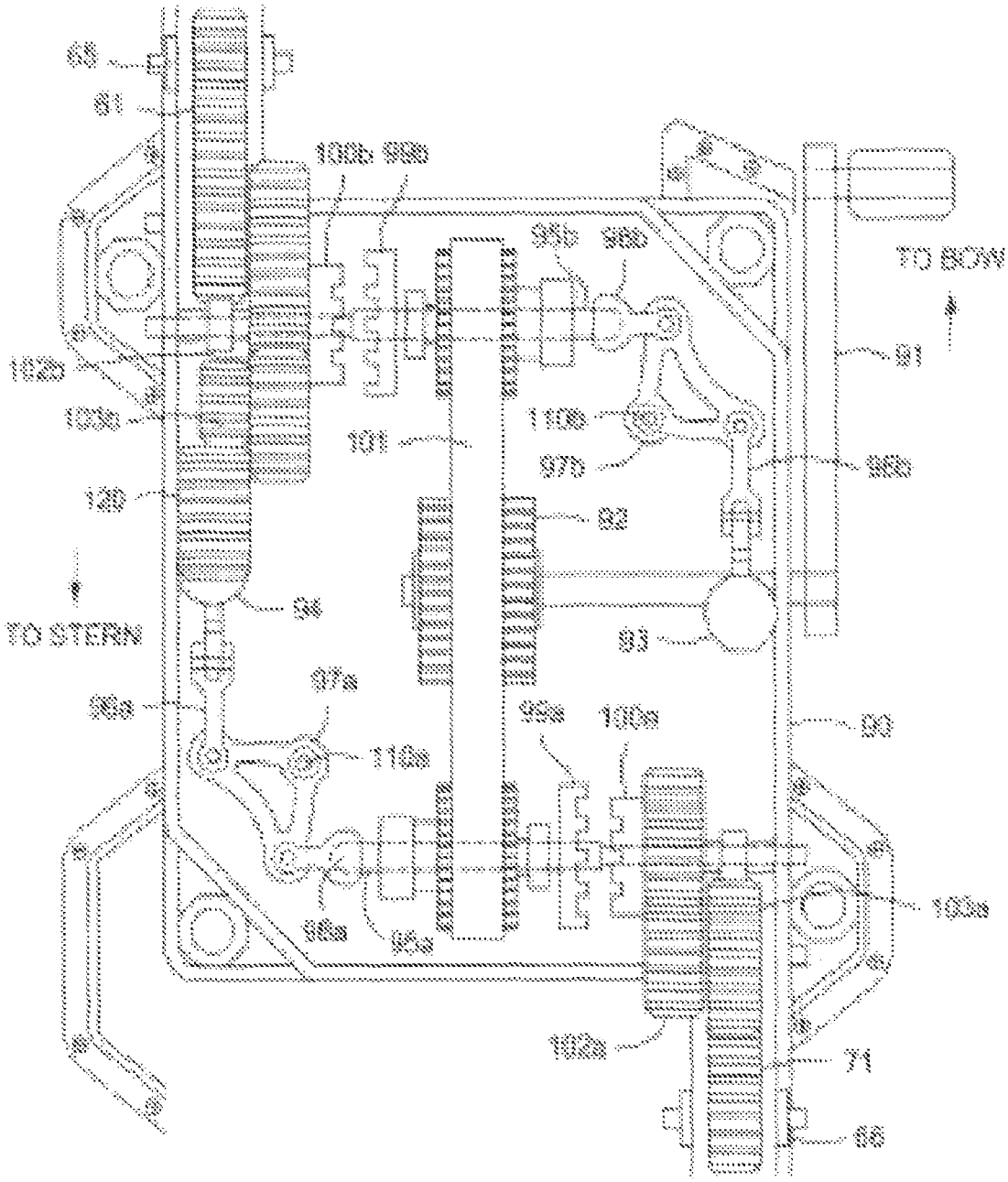
FIGS. 5A and 5B are top views of the interior mechanisms of a gear box according to a second embodiment of an anchoring system of the present invention.
Figure 5B:
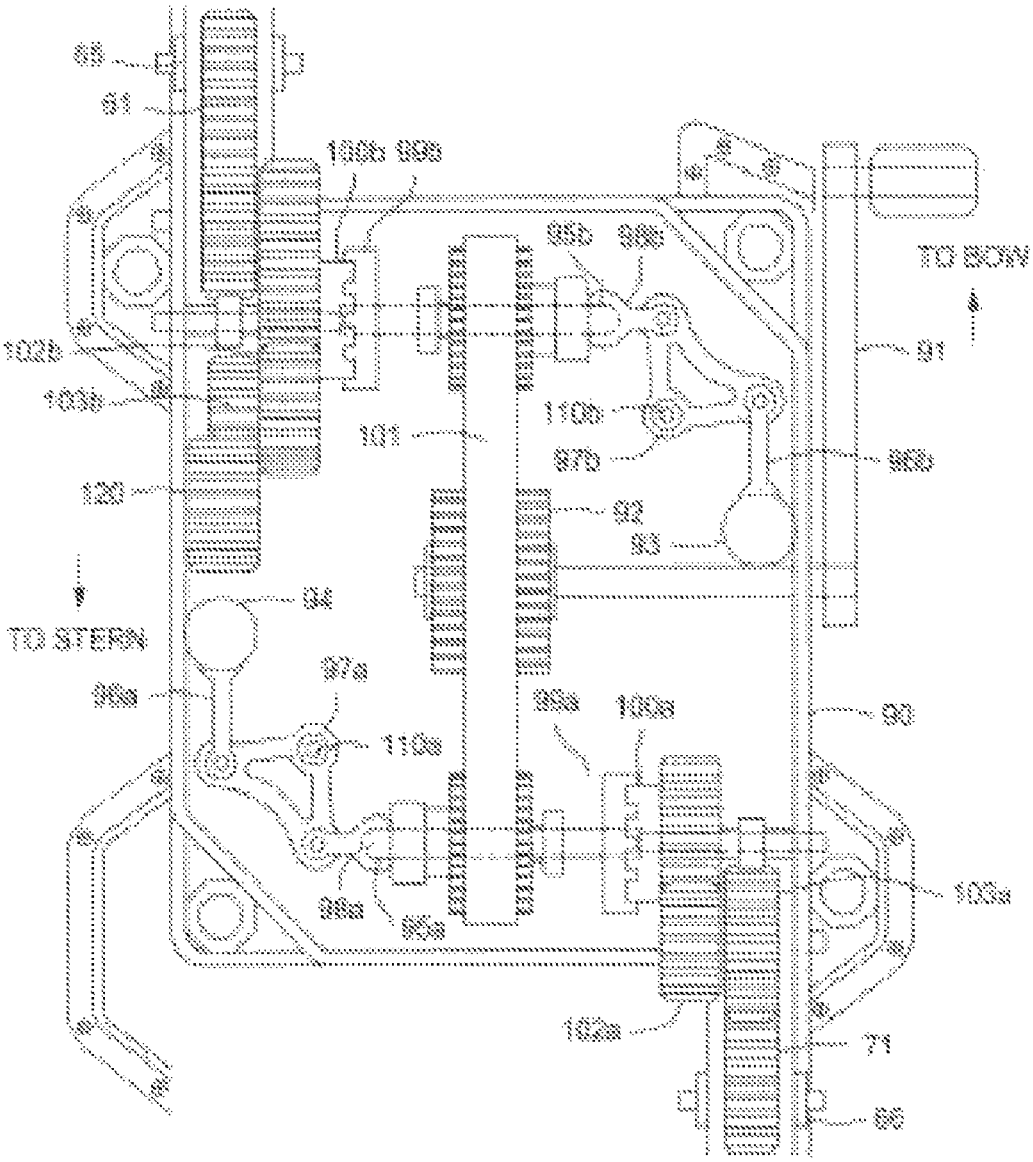
Figure 5C:
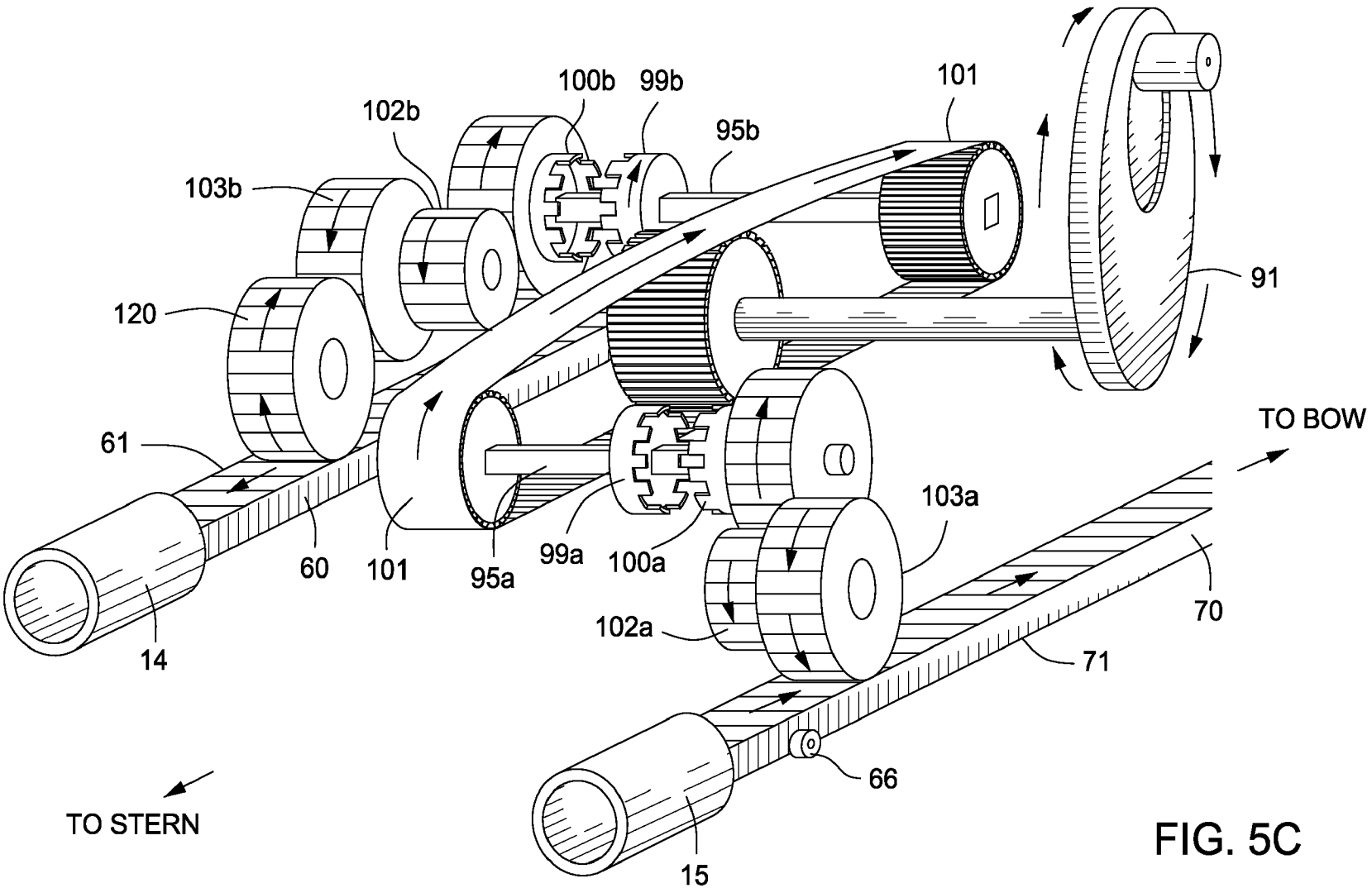
FIG. 5C is a perspective drawing of portions of the interior mechanisms illustrated in FIGS. 5A and 5B.

Referring now to FIGS. 5A, 5B and 5C, an alternative embodiment of a gear box in accordance with the present invention is illustrated. In this embodiment, the gear box 90 comprises a rotatable handle 91 for operative connection to the main gear 92 in gear box 90 and two actuation devices which are external to the gear box. In this embodiment, the actuation devices comprise levers 93 and 94. In FIGS. 5A-5C, the mechanism associated with lever 94 utilizes numeric reference designators which end in the letter "a," while the mechanism associated with lever 93 utilizes numeric reference designators ending in the letter "b." Components of each mechanism having the same numeric reference designator, but differing only in the ending letters "a" and "b" are the same. The following discussion first focuses on the structure and operation of the mechanism operatively connected to lever 94.

Lever 94 is operatively connected to shaft 95*a* via linkage 96*a*, tri-linkage 97*a* and ball linkage 98*a*. Tri-linkage 97*a* is rotatably mounted on hinge pin 110*a*. Shaft cog 99*a* is fixedly attached to shaft 95*a*. Lever ball 94 has two positions, and when lever ball 94 is moved between these two positions, shaft cog 99*a* engages or disengages slip bearing cog 100*a*. FIGS. 5A and 5C illustrate shaft cog 99*a* disengaged from slip bearing cog 100*a*, while FIG. 5B illustrates shaft cog 99*a* in engagement with slip bearing cog 100*a*. When shaft cog 99*a* is in engagement with slip bearing cog 100*a*, rotation of handle 91 drives belt 101, which in turn drives rack gears 102*a* and 103*a*. The teeth of rack gear 103*a* engage the toothed portion 71 of shaft 70, and, depending upon the direction of rotation of handle 91, the movement of rack gear 103 causes the probe portion 72 of shaft 70 either: (a) to leave the tube 15 and engage the bottom of the body of water in which the kayak is operating; or (b) to retract out of the body of water into tube 15.

Still referring to FIGS. 5A, 5B, and 5C, the mechanism operatively connected to lever 93 differs from the mechanism operatively connected to lever 94 by the addition of gear wheel 120. The additional gear wheel engages the toothed portions 61 of shaft 60. When shaft cog 99*b* is in engagement with slip bearing cog 100*b*, rotation of handle 91 causes the probe portion 62 of shaft 60 either: (a) to leave the tube 14 and engage the bottom of the body of water in which the kayak is operating; or (b) to retract out of the body of water into tube 14.

Figure 8:
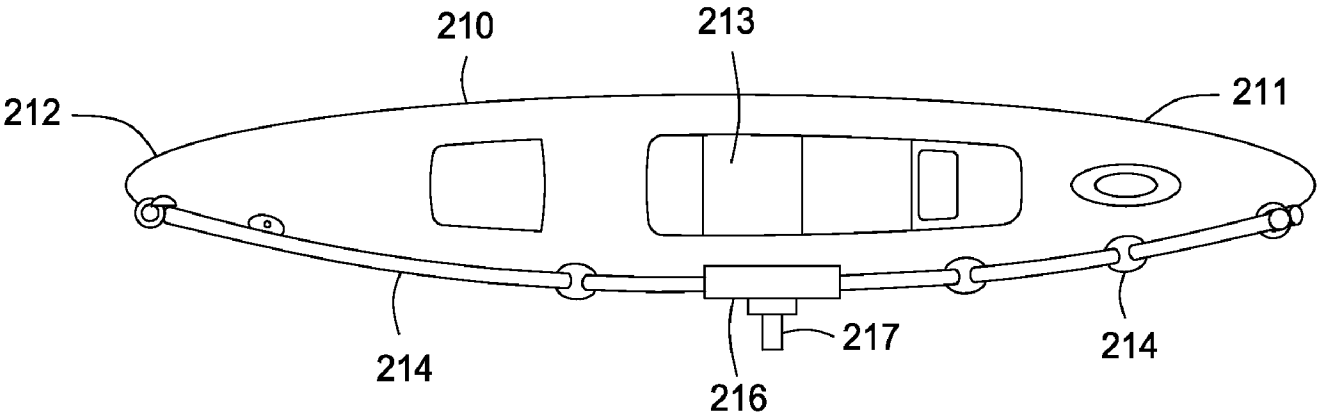
FIG. 8 is a top view of a kayak containing an alternative embodiment of anchoring apparatus in accordance with the present invention.
Figure 9:
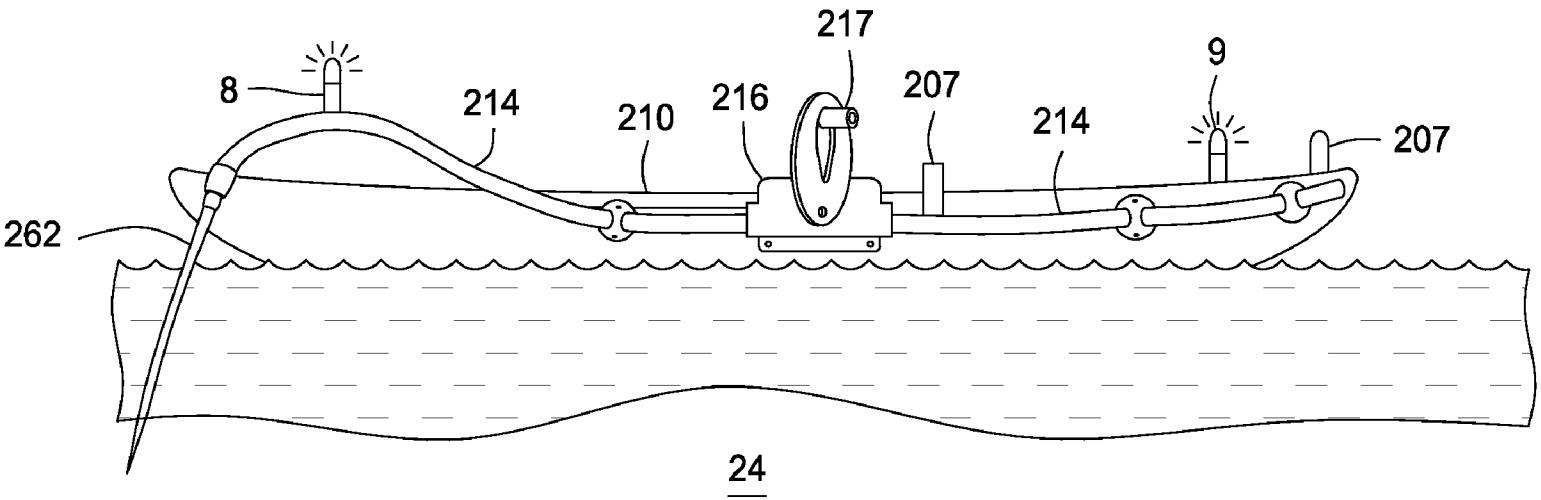
FIG. 9 is a side view of the kayak illustrated in FIG. 8.

Referring now to FIGS. 8 and 9, there is illustrated a kayak 210 having a bow 211, a stern 212 and a seat 213 which is interposed between the bow 211 and the stern 212. An alternative embodiment of an anchoring system in accordance with the present invention comprises tube 214 which has a length equal to approximately the length of kayak 210 and which may be located on either the right-hand or the left-hand side of kayak 210. Interposed between the ends of the tube 214 is a gear box 216 which comprises a handle 217 and which is located proximate the operator's seat 213.

Figure 10:
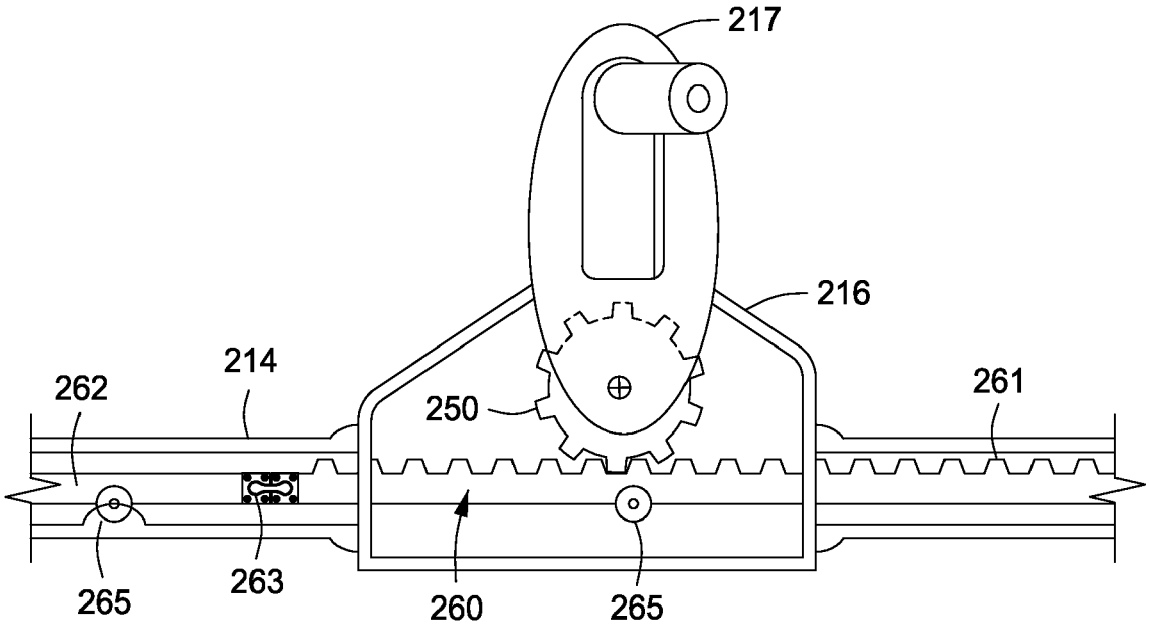
FIG. 10 is an elevation drawing in partial cross-section of a gear box that is used in the alternative embodiment of the anchoring system illustrated in FIGS. 8 and 9.

With reference now to FIG. 10, gear wheel 250 is located inside gear box 216 and is operatively connected to handle 217. The teeth of gear wheel 250 engage the toothed portion 261 of shaft 260. The shaft 260 also includes a probe portion 262 which may advantageously be coupled to the toothed portion 261 by utilizing connector bolt 263. As the handle 217 is rotated in a first direction, the probe portion 262 of shaft 260 is deployed from tube 214 and penetrates the bottom 24 of the body of water in which kayak 210 is floating. As the handle 217 is rotated in the opposite direction, the shaft 260 is retracted into tube 214.

Figure 7:
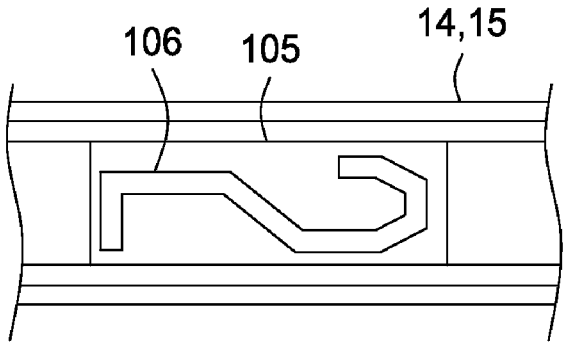
FIG. 7 is a cross-sectional view of a portion of one of the tubes illustrated in FIG. 1 taken along the longitudinal axis of the tube.

Accessories may be provided with anchoring apparatus according to the present invention. For example, with reference to FIG. 2, such accessories may include foldable lights 8, 9 which are attached to tubes 14 and 15, respectively, and which permit the kayak to be identified when lighting is dim. Additionally, such accessories may include depth indicators on the shafts 60, 70 which may be implemented by forming a window 105 in each tube 14, 15 as illustrated in FIG. 7 and applying markings 106 to the shafts 60, 70 to indicate the depth to which each shaft has been deployed. With reference to FIGS. 2 and 9, an additional accessory may comprise paddle holder, which is designated 7 in FIG. 2 and which is designated 207 and FIG. 9.

What is claimed is:

1. Apparatus for anchoring a kayak to the bottom of a body of water, said kayak comprising a hull having a bow and a stern and upper and lower portions, and a seat disposed in the hull between the bow and stern, said anchoring apparatus comprising:

a tube for attachment to the kayak proximate the upper portion of the kayak between the bow and the stern of the kayak, wherein said tube has opposed ends, a central substantially horizontal section between said opposed ends, and a length equal to approximately the length of the kayak, and wherein one of said tube ends is directed generally downward;

a shaft in said tube;

a gear box for attachment to the kayak proximate the seat which comprises: (i) a gear for operative engagement with the shaft; and (ii) a rotatable handle external to the gear box for operative connection to the gear in the gear box; the rotation of the handle in a first direction causing the shaft to deploy from a position inside the tube to a position outside the tube from said generally downwardly directed tube end and into engagement with the bottom of the body of water.

2. The apparatus of claim 1, wherein the shaft is deployed from the tube at a location proximate to the bow of the kayak.

3. The apparatus of claim 1, wherein the shaft is deployed from the tube at a location proximate to the stern of the kayak.

4. The apparatus of claim 1, further comprising rollers in the tube on which the shaft moves as it is deployed.

5. The apparatus of claim 1, further comprising at least one connector bolt in the shaft to permit rotation of the shaft as it is deployed.

6. The apparatus of claim 1, wherein the shaft may be returned to the tube by rotating the handle in the opposite direction to that in which it was rotated to deploy the shaft.

7. The apparatus of claim 1, wherein it further comprises a foldable light which is attached to the first tube.

8. The apparatus of claim 1, wherein it further comprises a depth indicator for the shaft.

9. The apparatus of claim 1, wherein it further comprises a paddle holder.

10. The apparatus of claim 1, wherein the shaft further comprises a rack and pinion gear driven shaft.

11. The apparatus of claim 1, wherein the shaft further comprises a toothed portion for operative engagement with the gear in the gear box.

12. The apparatus of claim 1, wherein the shaft further comprises a probe portion on the end of said shaft that is deployed from said tube, for engagement with the bottom of the body of water.

13. The apparatus of claim 12, wherein the probe portion is rotatably attached to the shaft with a connector bolt.

14. The apparatus of claim 1, wherein the shaft has opposed ends and wherein one shaft end is deployable from a position inside the tube to a position outside the tube and into engagement with the bottom of the body of water.

15. The apparatus of claim 14, wherein the shaft further comprises a probe portion, located at the shaft end being deployed, for engagement with the bottom of the body of water.

16. The apparatus of claim 15, wherein the probe portion is rotatably attached to the shaft with a connector bolt.

17. A kayak anchoring system for anchoring a kayak to the bottom of a body of water, comprising:

a. a kayak comprising a hull having a bow and a stern and upper and lower portions, and a seat disposed in the hull between the bow and stern; and b. an anchoring apparatus comprising:

i. a tube attached to the kayak proximate the upper portion of the kayak between the bow and the stern of the kayak, wherein said tube has a length equal to approximately the length of the kayak;

ii. a shaft in said tube;

iii. a gear box for attachment to the kayak proximate the seat which comprises: a gear for operative engagement with the shaft; and a rotatable handle external to the gear box for operative connection to the gear in the gear box; the rotation of the handle in a first direction causing the shaft to deploy from a position inside the tube to a position outside the tube and into engagement with the bottom of the body of water.

18. The system of claim 17, wherein the shaft is deployed from the tube at a location proximate to the bow of the kayak.

19. The system of claim 17, wherein the shaft is deployed from the tube at a location proximate to the stern of the kayak.

20. The system of claim 17, further comprising rollers in the tube on which the shaft moves as it is deployed.

21. The system of claim 17, further comprising at least one connector bolt in the shaft to permit rotation of the shaft as it is deployed.

22. The system of claim 17, wherein the shaft may be returned to the tube by rotating the handle in the opposite direction to that in which it was rotated to deploy the shaft.

23. The system of claim 17, wherein the anchoring apparatus further comprises a foldable light which is attached to the first tube.

24. The system of claim 17, wherein the anchoring apparatus further comprises a depth indicator for the shaft.

25. The system of claim 17, wherein the anchoring apparatus further comprises a paddle holder.

26. The system of claim 17, wherein the shaft further comprises a rack and pinion gear driven shaft.

27. The system of claim 17, wherein the shaft further comprises a toothed portion for operative engagement with the gear in the gear box.

28. The apparatus of claim 17, wherein the shaft further comprises a probe portion for engagement with the bottom of the body of water.

29. The apparatus of claim 28, wherein the probe portion is rotatably attached to the shaft with a connector bolt.

30. The apparatus of claim 17, wherein the shaft has opposed ends and wherein one shaft end is deployable from a position inside the tube to a position outside the tube and into engagement with the bottom of the body of water.

31. The apparatus of claim 30, wherein the shaft further comprises a probe portion, located at the shaft end being deployed, for engagement with the bottom of the body of water.

32. The apparatus of claim 31, wherein the probe portion is rotatably attached to the shaft with a connector bolt.

* * * * *